US009980581B2

(12) United States Patent
Mille et al.

(10) Patent No.: US 9,980,581 B2
(45) Date of Patent: May 29, 2018

(54) REFRIGERATED SALES CABINET

(71) Applicant: Carrier Corporation, Farmington, CT (US)

(72) Inventors: Sophie Mille, Hofheim am Taunus (DE); ZhenYu Wang, Ames, IA (US)

(73) Assignees: CARRIER CORPORATION, Farmington, CT (US); Carrier KÄLTETECHNIK DEUTSCHLAND GMBH, Cologne (DE)

( * ) Notice: Subject to any disclaimer, the term of this patent is extended or adjusted under 35 U.S.C. 154(b) by 333 days.

(21) Appl. No.: 14/429,956

(22) PCT Filed: Sep. 24, 2012

(86) PCT No.: PCT/EP2012/068776
§ 371 (c)(1),
(2) Date: Mar. 20, 2015

(87) PCT Pub. No.: WO2014/044330
PCT Pub. Date: Mar. 27, 2014

(65) Prior Publication Data

US 2015/0250332 A1 Sep. 10, 2015

(51) Int. Cl.
*A47F 3/04* (2006.01)
*E05D 7/00* (2006.01)
(Continued)

(52) U.S. Cl.
CPC ..... *A47F 3/0408* (2013.01); *A47B 87/002* (2013.01); *A47F 3/043* (2013.01);
(Continued)

(58) Field of Classification Search
CPC ..... A47F 3/0408; A47F 3/043; E05D 7/00; F25D 23/067; F25D 23/065; F25D 23/069
See application file for complete search history.

(56) References Cited

U.S. PATENT DOCUMENTS 3,307,373 A 3/1967 Booth
3,462,966 A 3/1967 Booth
(Continued)

FOREIGN PATENT DOCUMENTS

AU 2008201839 A1 11/2008
CA 2338807 A1 8/2002
(Continued)

OTHER PUBLICATIONS

International Search Report for application PCT/EP2012/068776, dated Aug. 8, 2013, 6 pages.
(Continued)

*Primary Examiner* — Elizabeth Martin
(74) *Attorney, Agent, or Firm* — Cantor Colburn LLP

(57) ABSTRACT

A refrigerated sales cabinet comprises a cabinet body providing a refrigerated sales space for supporting refrigerated goods to be presented therein; at least one door; and a door frame having a top post, a bottom post, and at least two upright posts. At least one of the posts comprises a main body having a constant cross-section including a rear wall portion, two side wall portions, respectively extending forward from the rear wall portion, and a support member extending between the two side wall portions. An insulating front element is attached to the support member by means of at least one connection element located in a central area of the support member of the main body, the central area laterally spaced apart from the two side wall portions.

21 Claims, 4 Drawing Sheets

(51) Int. Cl.
*E06B 7/14* (2006.01)
*A47B 87/00* (2006.01)

(52) U.S. Cl.
CPC ..... *A47F 3/0404* (2013.01); *A47F 3/0426* (2013.01); *A47F 3/0434* (2013.01); *E05D 7/00* (2013.01); *E06B 7/14* (2013.01); *Y10T 29/49359* (2015.01)

(56) References Cited

U.S. PATENT DOCUMENTS

| | | | |
|---|---|---|---|
| 4,478,047 | A | 10/1984 | Ibrahim |
| 4,831,780 | A | 5/1989 | Bockwinkel |
| 4,891,912 | A | 1/1990 | Bockwinkel |
| 4,941,289 | A | 7/1990 | Rolek |
| 5,600,966 | A | 2/1997 | Valence et al. |
| 5,645,330 | A | 7/1997 | Artwohl et al. |
| 5,816,060 | A | 10/1998 | Brownell et al. |
| 6,036,294 | A | 3/2000 | Banicevic |
| 6,367,223 | B1 | 4/2002 | Richardson et al. |
| 6,393,855 | B1 | 5/2002 | Schuchert et al. |
| 7,028,503 | B2 | 4/2006 | Lyvers |
| 7,119,306 | B2 | 10/2006 | Boryca et al. |
| 7,121,675 | B2 | 10/2006 | Ter-Hovhannisian |
| 7,293,848 | B2 | 11/2007 | Myers et al. |
| 7,410,229 | B2 | 8/2008 | Pohl et al. |
| 7,490,916 | B2 | 2/2009 | Anderson et al. |
| 7,905,101 | B2 | 3/2011 | Sunderland et al. |
| 8,074,469 | B2 | 12/2011 | Hamel et al. |
| 2011/0043089 | A1 | 2/2011 | Chubb |
| 2011/0252816 | A1 | 10/2011 | Kulkarni |
| 2011/0273065 | A1 | 11/2011 | Dickey et al. |
| 2011/0302944 | A1 | 12/2011 | Howington et al. |
| 2011/0304253 | A1 | 12/2011 | Howington et al. |
| 2012/0047919 | A1 | 3/2012 | Besore et al. |
| 2012/0102985 | A1 | 5/2012 | Tafoya et al. |

FOREIGN PATENT DOCUMENTS

| | | | |
|---|---|---|---|
| CA | 2492024 | A1 | 7/2006 |
| CN | 101644517 | A | 2/2010 |
| CN | 101653330 | A | 2/2010 |
| CN | 201635577 | U | 11/2010 |
| CN | 102483284 | A | 5/2012 |
| DE | 29903314 | U1 | 6/1999 |
| EP | 1517102 | A2 | 3/2005 |
| EP | 1574797 | A2 | 9/2005 |
| EP | 1586253 | A1 | 10/2005 |
| EP | 1908376 | A2 | 4/2008 |
| EP | 2096393 | A1 | 9/2009 |
| EP | 2426444 | A2 | 3/2012 |
| GB | 2379261 | A | 3/2003 |
| GB | 2379262 | A | 3/2003 |
| GB | 2462351 | A | 2/2010 |
| GB | 2468036 | A | 8/2010 |
| JP | 2012072967 | A | 4/2012 |
| JP | 2012107770 | A | 6/2012 |
| JP | 4971710 | B2 | 7/2012 |
| KR | 100259920 | B1 | 6/2000 |
| KR | 20040067197 | A | 7/2004 |
| KR | 20110047591 | A | 5/2011 |
| KR | 20110072774 | A | 6/2011 |
| KR | 20110089712 | A | 8/2011 |
| TW | 201042225 | A | 12/2010 |
| WO | 9516375 | A1 | 6/1995 |
| WO | 0011420 | A1 | 3/2000 |
| WO | 0058580 | A1 | 10/2000 |
| WO | 0075561 | A1 | 12/2000 |
| WO | 0193727 | A2 | 12/2001 |
| WO | 2005119124 | A2 | 12/2005 |
| WO | 2006067777 | A2 | 6/2006 |
| WO | 2006101559 | A1 | 9/2006 |
| WO | 2009073021 | A1 | 6/2009 |
| WO | 2010099439 | A2 | 9/2010 |
| WO | 2010124341 | A1 | 11/2010 |
| WO | 2011020677 | A2 | 2/2011 |
| WO | 2011023822 | A2 | 3/2011 |
| WO | 2011106587 | A2 | 9/2011 |
| WO | 2011115685 | A1 | 9/2011 |
| WO | 2011143705 | A1 | 11/2011 |
| WO | 2012089476 | A2 | 7/2012 |
| WO | 2012089512 | A2 | 7/2012 |

OTHER PUBLICATIONS

Chinese First Office Action and Search Report for Application CN2012800759783, search dated Feb. 28, 2017, 7 pages.

Chinese First Office Action and Search Report for Application CN2012800759783, search dated Sep. 7, 2017, 10 pages.

REFRIGERATED SALES CABINET

The present invention relates to a refrigerated sales cabinet.

Refrigerated sales cabinets as they are known in the art respectively comprise a cabinet body, side panels, a door frame and at least one door, wherein the side panels are installed on the sides of the cabinet body, the door frame is installed on the cabinet body, the door is installed on the door frame, and sealing strips are provided between the cabinet door and the door frame.

The door frame comprising a front surface, which is exposed to ambient conditions, is cooled when the refrigerated sales cabinet is operated. If the temperature of the front surface drops below the dew point, humid ambient air condensates at this front surface causing water droplets to appear, which is uncomfortable for the customers. Therefore, there is a need to prevent the temperature of this front surface to fall below the dew point temperature.

A door frame according to the prior art comprises an electrical heating element, which is operated to keep the temperature of the front surface above the dew point in order to prevent the condensation of ambient air on the door frame. The electrical energy consumed by such an electrical heating element is very high and considerably contributes to the total energy consumed by the refrigerated sales cabinet in operation.

It therefore would be beneficial to minimize the electrical energy consumption of the refrigerated sales cabinet while still reliably avoiding condensation at the front surface of a door frame of a refrigerated sales cabinet.

A refrigerated sales cabinet according to a first exemplary embodiment of the invention comprises a cabinet body providing a refrigerated sales space for supporting refrigerated goods to be presented therein, at least one door, a door frame having a top post, a bottom post, and at least two upright posts extending between the top post and the bottom post. At least one of the posts comprises a main body with a basically constant cross-section including a rear wall portion, two side wall portions, respectively extending forwards from the rear wall portion, and a support member extending between the two side wall portions. The post further includes an insulating front element comprising, from back to front, a rear panel, a front panel forming the front surface of the post, and a thermally insulating layer, which is arranged between the rear panel and the front panel. The insulating front element is attached to the support member by means of at least one connection element which is positioned in a central area of the support member of the main body. The central area is laterally spaced apart from the two side wall portions and the width of the area of contact between the insulating front element and the support member provided by the connection element, seen in a cross-sectional view, is less than 10%, in particular less than 5%, of the width of the support member.

In one embodiment, the central area of the support member is spaced equidistantly from the two side portions of the main body.

A refrigerated sales cabinet according to a second exemplary embodiment of the invention comprises a cabinet body providing a refrigerated sales space for supporting refrigerated goods to be presented therein, at least one door, a door frame having a top post, a bottom post, and at least two upright posts extending between the top post and the bottom post. At least one of the posts comprises an air duct allowing conducting air through the post. At least one fan is fluidly connected to the air duct allowing conveying air from the environment through the air duct by operating the fan.

An exemplary method for reducing condensation at the front of a refrigerated sales cabinet comprising a cabinet body providing a refrigerated sales space for supporting refrigerated goods to be sold therein, at least one door, a door frame having a top post, a bottom post, and at least two upright posts, each of the posts having a main body comprising a rear portion, two side portions extending from the rear portion and a front portion extending between the two side portions comprises the steps of: attaching a thermally insulating front element to the main body by means of at least one connection element, which is arranged at a central area of the front portion of the main body, wherein the central portion is laterally spaced apart from the two side portions and wherein the extension of the area of contact between the insulating front element and the front portion provided by the connection element in a direction parallel to the horizontal extension of the insulating front element is less than 10%, in particular less than 5%, of said horizontal extension of the insulating front element.

A further method of reducing condensation at the front of a refrigerated sales cabinet, which comprises a cabinet body having a refrigerated sales space for supporting refrigerated goods to be sold therein, at least one door, and a door frame having a top post, a bottom post and at least two upright posts extending between the top post and the bottom post, includes the step of blowing ambient air through an air duct provided in at least one of the posts.

The disclosure of the invention will become more easily understood with reference to the accompanying drawings. It is appreciated by those skilled in the art that the accompanying drawings are exemplary only and are not intended to limit the scope of protection of the invention. In the drawings.

FIGS. 1 to 5 and the following discussion describe particular embodiments of the invention so as to teach those skilled in the art how to produce and use the best modes of the invention. In order to teach the principle of the invention, several conventional aspects have been simplified or omitted. Those skilled in the art should understand that variations originating from these embodiments also fall within the scope of the invention. Those skilled in the art should understand that the features to be described below can be combined in various ways so as to form numerous variations of the invention. Therefore, the invention is not limited to the following particular embodiments and is merely defined by the appended claims and their equivalents.

FIRST EMBODIMENT

Figure 1:
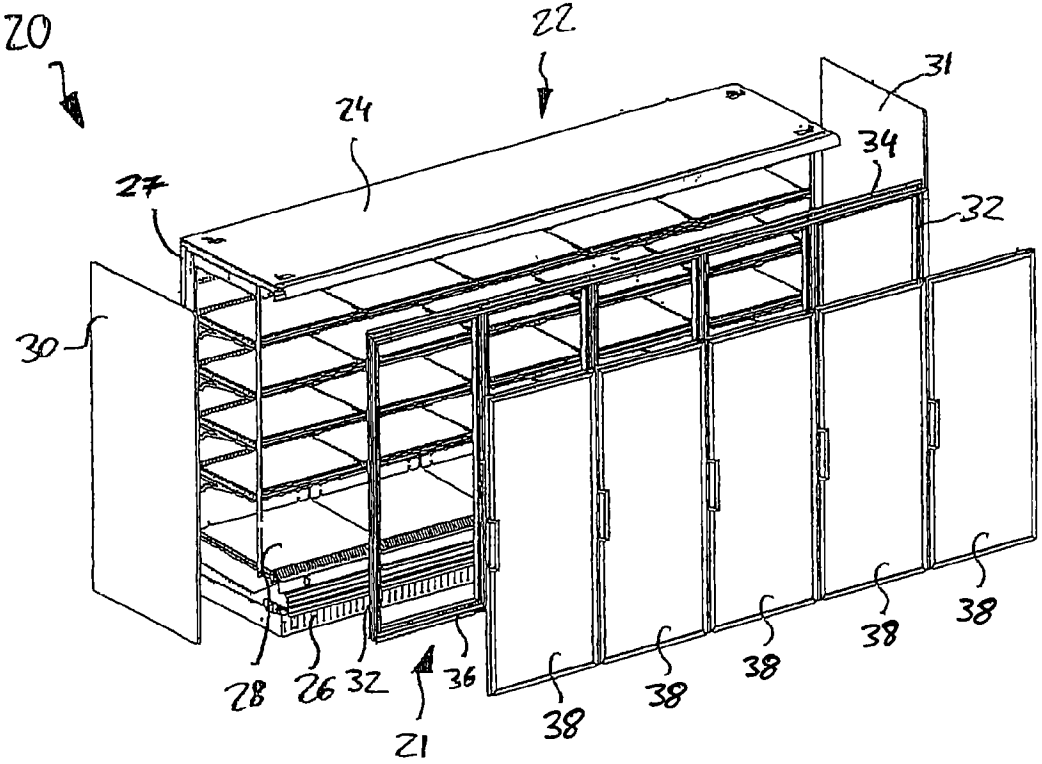
FIG. 1 shows an exploded view of a refrigerated sales cabinet of the front-access type with doors and a door frame according to a first embodiment of the invention.

A refrigerated sales cabinet 20 of the front-access type with doors 38 and a door frame 21 according to a first exemplary embodiment of the invention is shown in FIG. 1.

The refrigerated sales cabinet 20 as shown in FIG. 1 comprises a cabinet body 22, a left side panel 30, a right side panel 31, a door frame 21 and a plurality of doors 38. The cabinet body 22 comprises a bottom part 26, a roof plate 24, a rear wall 27 and a plurality of shelves 28 arranged in between.

A complete refrigeration circuit comprising a compressor, a condenser, an expansion device and an evaporator may be installed in the cabinet body 22, in order to provide a standalone refrigerated cabinet which only needs to be connected to an electric power supply for operation.

Alternatively, only one or more evaporators may be installed within the cabinet body 22, the evaporators being configured to be fluidly connected to an external refrigeration circuit provided in the building in which the refrigerated sales cabinet is to be installed.

The refrigerated sales cabinet 20 may be a cooling sales cabinet 20 which is configured to cool the goods presentation space to cooling temperatures above 0° C.

Alternatively, the refrigerated sales cabinet 20 may be a freezing sales cabinet 20, which is configured to cool the goods presentation space to freezing temperatures below 0° C., in particular to temperatures below −15° C. in order to store and present frozen goods to potential customers.

The left side panel 30 and the right side panel 31 are respectively installed on the left and right hand side of the cabinet body 22. The door frame 21, which comprises a plurality of vertical extending upright posts 32, a horizontal top post 34 and a horizontal bottom post 36, respectively connecting the upright posts 32 to each other, is installed on a front side of the cabinet body 22.

A plurality of cabinet doors 38 is installed on the front side of the door frame 21. The cabinet body 22, the left side panel 30, the right side panel 31, the door frame 21 and the cabinet doors 38 are installed together to form a refrigerated goods storage and presentations space which is closed by and accessible through the doors 38.

Figure 2:
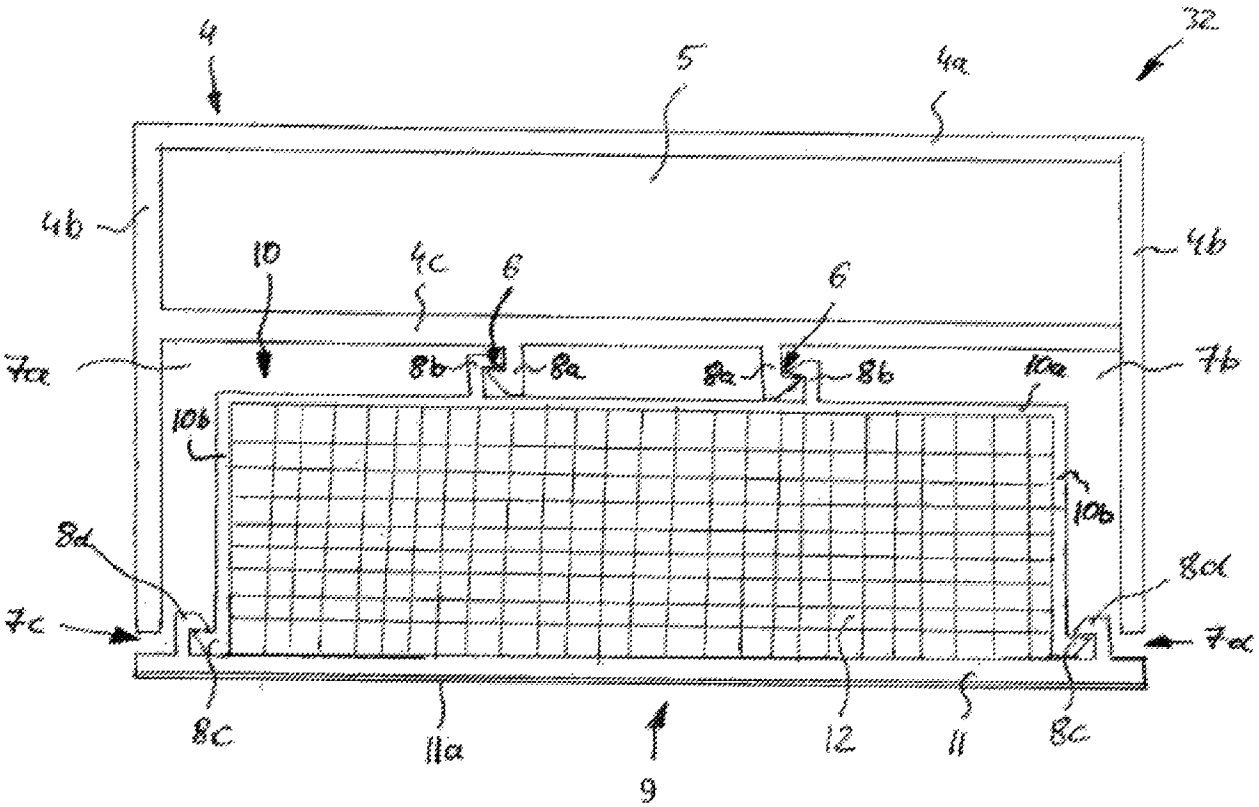
FIG. 2 shows a horizontal cross section through one of the upright posts of the door frame.

FIG. 2 shows an exemplary embodiment of a horizontal cross section through one of the upright posts 32 of the door frame 21.

In accordance with an embodiment of the invention each upright post 32 includes a rigid main body 4, which may be made of aluminium or another high strength material, as e.g. glass reinforced plastic, and which comprises a basically C-shaped cross section, when looked at in the cross-section, comprising a rear portion 4*a* and two side portions 4*b*.

The rear portion 4*a* and the two side portions 4*b* are exposed to the refrigerated goods presentation space and are thus cooled to low temperatures when the refrigerated sales cabinet 20 is operated.

The side portions 4*b* are arranged basically parallel to each other and perpendicular to the rear portion 4*a*. A support member 4*c* is arranged within the main body 4 extending basically parallel to the rear portion 4*a* and providing an elongated first hollow space 5 within the main body 4, the elongated hollow space 5 being defined by the support member 4*c*, the rear portion 4*a* and the two side portions 4*b*. Optionally, the first hollow space 5 may be filled with an insulating material, e.g. a thermally insulating foam, in order to enhance the thermally insulating properties of the upright post 32.

A front side of the support member 4*c* facing the doors 38, which are not shown in FIG. 2, is provided with two first fastening bracket members 8*a*, which are formed as hooks basically extending opposite to each other in a plane which extends basically parallel to the plane of the support member 4*c*. An insulating front element 9 is attached to the support member 4*c* by means of corresponding second fastening bracket members 8*b*, which are provided at the rear side of a rear panel 10 of the insulating front element 9 and engage with the first fastening bracket members 8*a* provided at the support member 4*c*. The mutual engagement of the fastening bracket members 8*a*, 8*b* allows to conveniently and securely attach the insulating front element 9 to the main body 4 of the upright post 32.

The first and second fastening bracket members 8*a*, 8*b* are arranged in a central portion of the support member 4*c*, which is spaced apart from the two side portions 4*b*, in order to reduce the transfer of heat (thermal energy) from the insulating front element 9 to the main body 4 via the fastening bracket members 8*a*, 8*b*. In particular, each of the bracket members 8*a*, 8*b* is spaced at least 15 mm from the respective closest side portion 4*b*.

In order to reduce the transfer of heat via the fastening bracket members 8*a*, 8*b* even further, the area of contact 6 between the first and second fastening bracket members 8*a*, 8*b* is made as small as possible. In particular, the width of the area of contact 6 measured parallel to the extension of the support member 4*c* is configured to be not larger than 10% of the width of said support member 4*c* and not to exceed 8 mm. In an alternative embodiment the extension of the support member 4*c* is configured to be not larger than 5% of the width of the support member 4*c* and does not exceed 5 mm The fastening bracket members 8*a*, 8*b* respectively comprise at least one hook, the hooks of the first and second fastening bracket members 8*a*, 8*b* hooking into each other in order to attach the insulating front element 9 to the main body 4. At least one of the hooks of the insulating front element 9 and/or of the main body 4 is provided with an inclined surface respectively facing away from the insulating front element 9 or the main body 4. Providing hooks with inclined surfaces facilitates the movement of the hooks into their mutually engaging position.

The insulating front element 9 includes the rear panel 10 facing the support member 4*c* and comprising the corresponding second fastening bracket members 8*b* mentioned before. The rear panel 10 comprises a basically planar central portion 10*a* and two side wall strips 10*b* extending basically rectangularly from the plane of the central portion 10*a* thereby forming a C-shape when looked at in the cross-section. The rear panel 10 extends basically parallel to the rear portion 4*a* of the main body 4 spanning the distance between the two side portions 4*b* and providing two L-shaped hollow spaces 7*a*, 7*b*, which are respectively defined by the insulating front element 9 and the main body 4, in particular by the rear panel 10, one of the lateral side wall strips 10*b*, one of the side portions 4*b* and the support member 4*c*.

The insulating front element 9 further comprises a basically planar front panel 11, which is arranged facing the doors (not shown) opposite to the rear panel 10 on the front side of the insulating front element 9. The front panel 11 is attached to the side wall strips 10*b* of the rear panel 10 by means of a further snap on connection provided by third and fourth fastening bracket members 8*c*, 8*d* engaging with each other, which are respectively formed at the front end of the side wall strips 10*b* and the rear side of the front panel 11 facing the rear panel 10.

When installed at the main body 4, the front panel 11 of the insulating front element 9 does not contact the side portions 4*b* of the main body 4, but air gaps 7*c*, 7*d* are formed between the front panel 11 and the side portions 4*b*, in order to reduce or even avoid heat from flowing from the front panel 11, which is exposed to ambient air, to the main body 4 facing the refrigerated sales space.

The hollow spaces 7*a*, 7*b* and the air gaps 7*c*, 7*d* provide additional thermal insulation between the insulating front element 9 and the main body 4 reducing the transfer of heat from the front panel 11 of the insulating front element 9 to the main body 4 in order to reduce or even avoid the condensation of ambient air at the front panel 11 of the insulating front element 9.

A thermally insulating coating 11*a* enhancing the thermal insulating properties of the insulating front element 9 may by applied to the front panel 11. As such a thermally insulating coating 11*a*, which e.g. may apply nano-technology resulting in a very low thermal conductivity of e.g. less than 0.02 W/mK, provides a very efficient thermally insulating coating 11*a*, a thin coating, which does not considerably add to the thickness of the front panel 11 and which may e.g. be applied by spraying, may be sufficient in order to reliably prevent the condensation of ambient air on the front side of the refrigerating sales cabinet 20. The thermally insulating coating 11*a* can be a clear and mole preventing coating used to insulate. It can be non-hazardous and water-based.

An example for a suitable nano-technology based material is for example provided by "Nansulate"®, which is commercially available.

Optionally at least a portion of the rear panel 10, in particular the back-side of the rear panel 10 facing the main body 4, may be covered with a thermally insulating coating, as well, in order to reduce the transfer of heat through the insulating front element 9 even further.

A thermally insulating layer 12 is provided on the front side of the rear panel 10 of the insulating front element 9 facing the front panel 11. Said thermally insulating layer 12 may be enclosed within the insulating front element 9 in between the rear panel 10, the lateral side wall strips 10*b* and the front panel 11. Such an enclosure within the insulating front element 9 protects the thermally insulating layer 12 from being damaged, e.g. by the doors 38 or clumsy customers hitting the upright post 32, and further allows an easy installation of the thermally insulating layer 12 at the main body 4 of the upright post 32.

The thermally insulating layer 12 may include a thermally insulating foam, an aerogel based on nano technology and/or a vacuum panel in order to provide thermal insulation.

The rear and front panels 10, 11 of the insulating front element 9 may be made of any suitable plastic or metallic material, e.g. Aluminium or PVC, or a combination thereof.

SECOND EMBODIMENT

Figure 3:
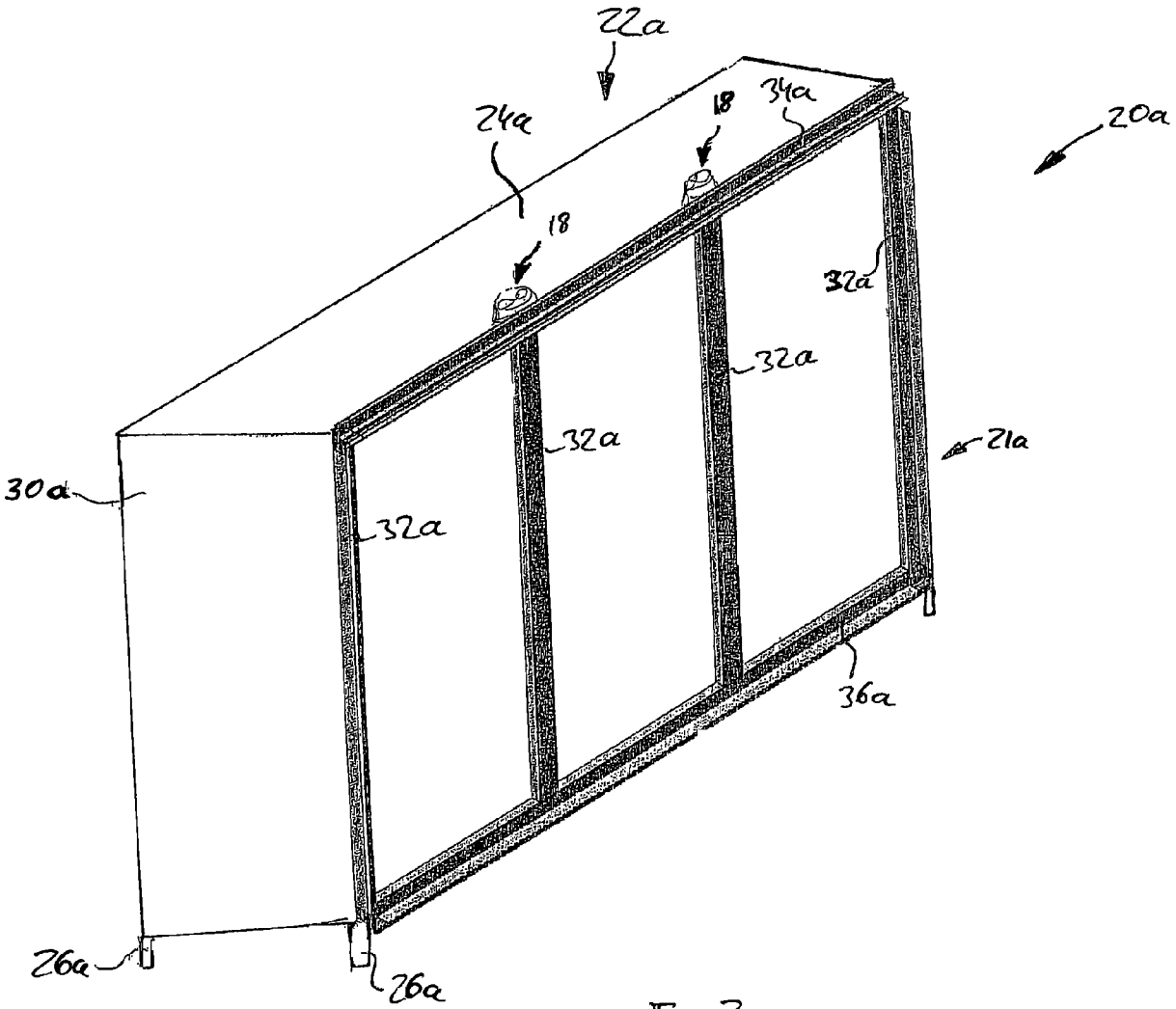
FIG. 3 shows an exploded view of a refrigerated sales cabinet of the front-access type with doors and a door frame according to a second embodiment of the invention.

A perspective view of a refrigerated sales cabinet 20*a* of the front-access type according to a second exemplary embodiment of the invention is shown in FIG. 3.

The refrigerated sales cabinet 20*a* according to the second embodiment shown in FIG. 3 is similar to the first embodiment shown in FIG. 1 comprising a cabinet body 22*a*, a left side panel 30*a*, a right side panel (not shown), and a door frame 21*a* which is configured for mounting a plurality of doors, which are not shown in FIG. 3. Similar to the first embodiment the cabinet body 22*a* comprises a bottom part 26*a*, a roof plate 24*a*, a rear wall (not shown) and a plurality of shelves (not shown) arranged in between.

Again, a complete refrigeration circuit comprising a compressor, a condenser, an expansion device and an evaporator may be installed in the cabinet body 22*a*, in order to provide a standalone refrigerated cabinet which only needs to be connected to an electric power supply for operation.

Alternatively, only one or more evaporators may be installed within the cabinet body 22*a*, the evaporators being configured to be fluidly connected to an external refrigeration circuit provided in the building in which the refrigerated sales cabinet is to be installed.

The refrigerated sales cabinet 20*a* may be a cooling sales cabinet 20*a* which is configured to cool the goods presentation space to cooling temperatures above 0° C.

Alternatively or additionally, the refrigerated sales cabinet 20*a* may be a freezing sales cabinet 20*a*, which is configured to cool the goods presentation space to freezing temperatures below 0° C., in particular to temperatures below −15° C. in order to store and present frozen goods to potential customers.

The left side panel 30*a* and the right side panel (not shown) are respectively installed on the left and right hand side of the cabinet body 22*a*. The door frame 21*a*, comprising a plurality of vertical extending upright posts 32*a*, a horizontal top post 34*a* and a horizontal bottom post 36*a*, respectively connecting the upright posts 32*a* to each other, is installed on a front side of the cabinet body 22*a*.

A plurality of cabinet doors, which are not shown in FIG. 3, may be installed on the front side of the door frame 21*a*. The cabinet body 22*a*, the left side panel 30*a*, the right side panel 31, the door frame 21*a* and the cabinet doors are installed together to form a refrigerated goods storage and presentations space which is closed by and accessible through the doors.

A cavity extending along the length of the respective post 32*a*, 34*a*, 36*a* is formed in at least some of the posts 32*a*, 34*a*, 36*a* forming the door frame 21*a* in order to allow air to flow though the respective post 32*a*, 34*a*, 36*a*. Two fans 18 are arranged on top of the door frame 21*a* above the upper ends of two middle upright posts 32*a*. The fans 18 are configured to blow comparatively warm air, which collects in an upper portion of the room on top of the cabinet body 22*a*, through the cavities provided within the posts 32*a*, 34*a*, 36*a* heating the posts 32*a*, 34*a*, 36*a* in order to avoid that the temperature of the posts 32*a*, 34*a*, 36*a* falls below the dew point and humid air from the environment condensates at the front side of the posts 32*a*, 34*a*, 36*a* when the refrigeration circuit of the refrigerated sales cabinet 20*a* is operating cooling the refrigerated sales space and the main body 4 of the posts 32*a*, 34*a*, 36*a* facing the refrigerated sales space.

The skilled person will easily understand that the two fans 18 shown in FIG. 3 are only exemplary and any number of fans 18, which is considered as being appropriate, may be used. In an alternative embodiment, which is not shown in the Figures, the fans 18 may be arranged at the bottom of the door frame 21*a* and be configured for sucking air from the top of the cabinet body 22*a* through the cavities provided within the posts 32*a*, 34*a*, 36*a*.

Figure 4:
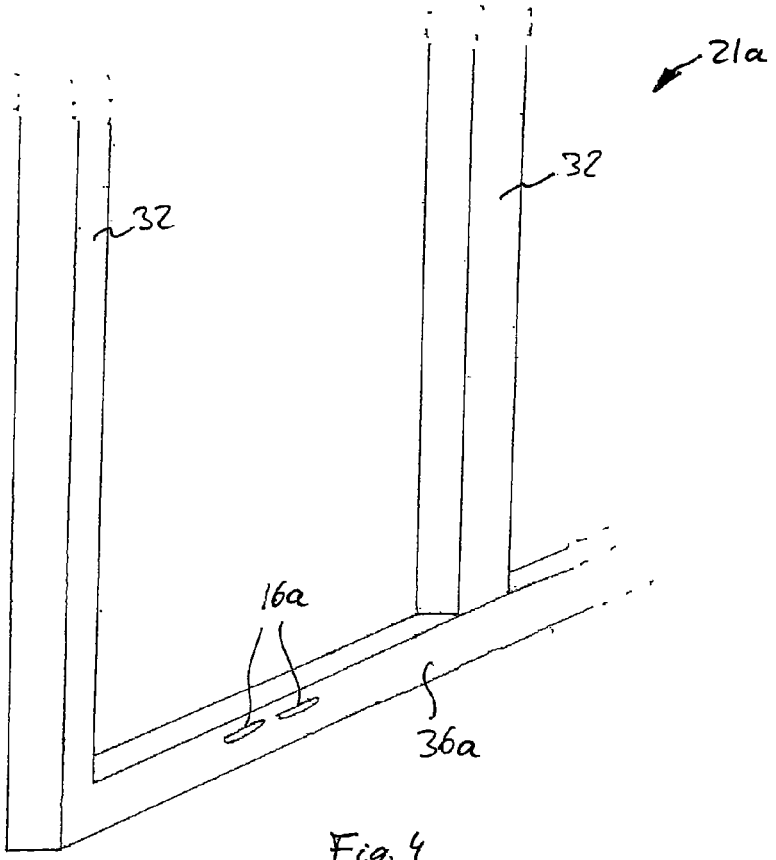
FIG. 4 shows an enlarged view of a portion of a door frame of a refrigerated sales cabinet according to a second embodiment of the invention.

FIG. 4 shows an enlarged view of the lower left corner of the door frame 21*a* comprising the horizontal bottom post 36*a* and two upright posts 32*a*. Two air outlets 16*a* are formed in the front side of the horizontal bottom post 36*a* allowing the air blown into the door frame 21*a* by means of the fans 18 to exit the door frame 21*a*. The skilled person will easily understand that additional air outlets 16*a* may be formed in the post 36*a* or a lower portion of the upright posts 32*a*, if necessary.

When the refrigeration circuit cooling the refrigerated sales space is operating, the portions of the door frame 21*a* exposed to the cooled good presentation space are cooled, and consequently the air flowing through the posts 32*a*, 34*a*,

36*a* of the door frame 21*a* is cooled, as well. In consequence, humidity comprised in the warm air entering the door frame 21*a* may condensate on its way through the door frame 21*a*. The condensation water, which is formed, may stick to the inner walls of the posts 32*a*, 34*a*, 36*a* or exit the door frame 21*a* via the air outlets 16*a* together with the air resulting in a puddle of water formed in front of the door frame 21*a*, which is inconvenient and may be dangerous for potential customers standing in front of or walking by the cabinet body 22*a*. Thus, an air-liquid-separator 14 is formed within or below the horizontal bottom post 36*a* in order to separate the condensation water from the air before exiting the door frame 21*a*.

Figure 5:
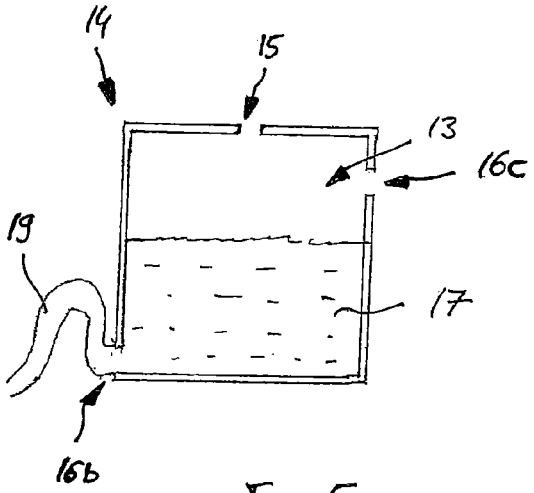
FIG. 5 shows a schematic view of an air-liquid-separator.

A schematic cross-sectional view of such an air-liquid-separator 14 is shown in FIG. 5. The air-liquid-separator 14 comprises a cavity 13 formed by, within or below the horizontal bottom post 36*a*, having an air-liquid inlet 15 at its top, an air outlet 16*c* in its upper portion and a liquid outlet 16*b* at the bottom. The air-liquid-mixture, which has passed the door frame 21*a* and comprises condensation water 17, enters into the cavity 13 via the air-liquid inlet 15. The condensation water 17 comprised in said air-liquid-mixture will collect at the bottom of the cavity 13, while the gaseous portion of the air-liquid-mixture will exit through the upper air outlet 16*c*. The condensation water 17 collected at the bottom of the cavity 13 may exit the cavity 13 via the liquid outlet 16*b* formed in a lower portion of the air-liquid-separator 14, which is connected to a drain 19 for dispensing the condensation water 17.

In an embodiment of a refrigerated sales cabinet according to an exemplary embodiment of the invention the insulating front element is attached to the support member of the main body by means of a snap-on connection comprising a first fastening bracket formed at the support member that engages with a corresponding second fastening bracket formed at the rear side of the rear panel. A snap-on connection comprising a first fastening bracket formed at the support member that engages with a corresponding second fastening bracket formed at the rear side of the rear panel provides a convenient way of attaching the insulating front element to the support member with a small area of contact, thereby reducing the transfer of heat from the insulating front element to the support member.

In an embodiment the fastening brackets respectively comprise at least one hook, wherein the hooks of the first and second fastening brackets hook into each other in order to attach the insulating front element to the main body. In an embodiment the at least one hook of the front element is provided with an inclined surface facing away from the front element and the at least one hook of the main body is provided with an inclined surface facing away from the main body. Hooks comprising such inclined surfaces allow an easy engagement of the hooks/fastening brackets.

In an embodiment the fastening brackets are formed as extruded elements extending along the length of the post. Extrusion provides a cheap and convenient method of forming the fastening brackets.

In an embodiment the snap-on connection is symmetrical with respect to a symmetry plane extending along the length of the post being oriented perpendicular to the plane of the insulating front element. A symmetric snap-on connection is easy to produce and provides a good thermal insulation, as the distance to the cold parts of the main body may be maximized.

In an embodiment the front panel does not contact the main body and there is no contact between the rear panel and the main body other than the contact provided by the at least one connection element. In an embodiment there is a gap of at least 3 mm between the insulating front element and the main body. Such a gap minimizes the flow of heat from the insulating element to the main body.

In an embodiment the insulating front element comprises, from back to front, a rear panel, a front panel forming the front surface of the post, and a thermally insulating layer, which is arranged between the rear panel and the front panel and comprises a thermally insulating nanoporous aerogel, foam and/or a vacuum panel. Providing a thermally insulating layer within the insulating front element enhances the thermal insulating properties of the insulating front element and contributes to reduce the risk of condensation at its front side.

In an embodiment said thermally insulating layer is sandwiched between said rear panel and said front panel, and/or said rear panel and said front panel together with two respective side wall strips completely enclose said thermally insulating layer. Such an enclosure within the insulating front element protects the thermally insulating layer from being damaged, e.g. by the doors or clumsy customers hitting the upright post and further allows an easy installation of the thermally insulating layer at the main body of the upright post.

In an embodiment the rear panel and/or the front panel comprise a plastic material, particularly PVC. Plastic and in particular PVC is a cheap material, which is well suited for forming the rear panel and/or the front panel of the insulating front element.

In an embodiment the rear panel and the front panel are attached to each other by means of a second snap-on connection. A snap-on connection provides a convenient measure for attaching the rear panel to the front panel.

In an embodiment at least a front surface of the front panel and/or a portion of the rear panel are covered with a thermally insulating coating, in particular a coating which employs nano-technology for providing thermal insulation against the main body of the post. Covering the front panel and/or the rear panel at least partially with a thermally insulating coating enhanced the thermal insulating properties of the panels and thereby helps to reduce the risk of condensation at the front panel.

In an embodiment an electrical heater is provided in the insulating front element in order to avoid condensation at front element. As the front element is thermally insulated, less energy for heating is needed in order to reliably avoid condensation at front element. The electrical heater in particular may be the arranged adjacent to or in contact with the front panel in order to provide an efficient heat transfer from the electrical heater to the front element.

In an embodiment the at least one fan provided at the refrigerated sales cabinet is configured for conveying air from the top of the refrigerated sales cabinet to a lower portion of the refrigerated sales cabinet. Due to the laws of thermodynamics warm air, which is particularly suited for heating the main body, collects on top of the refrigerated sales cabinet. Thus, directing air from the top of the refrigerated sales cabinet through the cavities formed within the door frame is specifically efficient for heating the door frame in order to avoid or at least reduce the condensation of ambient air at its front.

In an embodiment the at least one fan is located at the top of the cabinet body and configured for squeezing the air through the door frame. Alternatively, the fan may be provided in a lower portion of the door frame in order to suck air from the top to the bottom of the door frame.

In an embodiment an air-liquid-separator is provided in order to separate condensation water from the air-liquid-mixture before it exits the air duct. Such a separation avoids that air comprising condensed water forming a puddle of water, which would be annoying for customers standing in front of or walking by the refrigerated sales cabinet, is dispensed from the air duct.

In an embodiment a liquid outlet of the air-liquid-separator is fluidly connected to a water drain of the refrigerated sales cabinet in order to efficiently dispense the condensation water separated by the air-liquid-separator.

In an embodiment the refrigerated sales cabinet is configured to cool the refrigerated sales space down to freezing temperatures below 0° C., in particular to temperatures below −15° C. in order to store and present frozen goods to potential customers.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention is not limited to the particular embodiment disclosed, but that the invention will include all embodiments falling within the scope of the appended claims.

LIST OF REFERENCE NUMERALS

4 main body of a post
4*a* rear portion of a post
4*b* side portions of a post
4*c* support member of a post
5 first hollow space
6 contact area
7*a*, 7*b* second hollow spaces
7*c*, 7*d* air gaps
8*a*, 8*b* first and second fastening bracket members
8*c*, 8*d* third and fourth fastening bracket members
9 insulating front element
10 rear panel
10*a* central portion
10*b* side wall strips
11 front panel
11*a* thermally insulating coating
12 thermally insulating layer
13 cavity
14 air-liquid separator
15 air-liquid inlet
16*a*, 16*c* air outlets
16*b* liquid outlet
17 condensation water
18 fan
19 drain
20, 20*a* refrigerated sales cabinet
21, 21*a* door frame
22, 22*a* cabinet body
24, 24*a* roof plate
26, 26*a*, bottom part
27 rear wall
28 shelves
30, 30*a* left side panel
31 right side panel
32, 32*a* upright post
34, 34*a* top post
36, 36*a* bottom post
38 door

The invention claimed is:

1. A refrigerated sales cabinet, comprising:

a cabinet body providing a refrigerated sales space for supporting refrigerated goods to be presented therein;

at least one door;

a door frame having a top post, a bottom post, and at least two upright posts;

wherein at least one of the posts comprises:

a main body having a constant cross-section including a rear wall portion, two side wall portions, respectively extending forward from the rear wall portion, and a support member extending between the two side wall portions;

an insulating front element, which is attached to the support member by means of at least one connection element located in a central area of the support member of the main body, the central area being laterally spaced apart from the two side wall portions;

wherein the width of the area of contact at the connection element between the insulating front element and the support member, seen in a cross-sectional view, is less than 10% of the width of the support member.

2. The refrigerated sales cabinet of claim 1, wherein the insulating front element is attached to the support member of the main body by means of a snap-on connection comprising a first fastening bracket formed at the support member that engages with a corresponding second fastening bracket formed at the rear side of the insulating front element.

3. The refrigerated sales cabinet of claim 2, wherein the fastening brackets respectively comprise at least one hook, the hooks of the first and second fastening brackets hooking into each other in order to attach the insulating front element to the main body.

4. The refrigerated sales cabinet of claim 3, wherein the at least one hook of the insulating front element is provided with an inclined surface facing away from the insulating front element.

5. The refrigerated sales cabinet of claim 3, wherein the at least one hook of the main body is provided with an inclined surface facing away from the main body.

6. The refrigerated sales cabinet of claim 2, wherein the fastening brackets are formed as extruded elements extending along the length of the post.

7. The refrigerated sales cabinet of claim 1, wherein the snap-on connection is symmetrical with respect to a symmetry plane of the post.

8. The refrigerated sales cabinet of claim 1, wherein there is no contact between the insulating front element and the main body other than the contact provided by the at least one connection element.

9. The refrigerated sales cabinet of claim 8, wherein there is at least one gap of at least 3 mm between the insulating front element and the main body.

10. The refrigerated sales cabinet of claim 1, comprising an electrical heater arranged in the insulating front element.

11. The refrigerated sales cabinet of claim 1, wherein said insulating front element comprises, from back to front, a rear panel, a front panel forming the front surface of the post, and a thermally insulating layer arranged between the rear panel and the front panel.

12. The refrigerated sales cabinet of claim 11, wherein said thermally insulating layer is sandwiched between said rear panel and said front panel.

13. The refrigerated sales cabinet of claim 11, wherein at least one of the rear panel and the front panel comprises a plastic material.

14. The refrigerated sales cabinet of claim 11, wherein the rear panel and the front panel are attached to each other by means of a second snap-on connection provided by third and fourth fastening bracket members.

15. The refrigerated sales cabinet of claim 11, wherein at least one of a front surface of the front panel and a portion of the rear panel is covered with a thermally insulating coating.

16. The refrigerated sales cabinet of claim 11, wherein an electrical heater is arranged adjacent to the front panel.

17. The refrigerated sales cabinet of claim 11, wherein the thermally insulating layer comprises at least one of a thermally insulating foam, a nanoporous aerogel and a vacuum panel.

18. The refrigerated sales cabinet of claim 11, wherein said rear panel and said front panel together with two respective side wall strips completely enclose said thermally insulating layer.

19. The refrigerated sales cabinet of claim 15, wherein the coating employs nano-technology for providing thermal insulation.

20. The refrigerated sales cabinet of claim 11, wherein an electrical heater is arranged adjacent in contact with the front panel.

21. A method of reducing condensation at the front of a refrigerated sales cabinet comprising:

a cabinet body providing a refrigerated sales space for supporting refrigerated goods to be sold therein;

at least one door;

a door frame having a top post, a bottom post, and at least two upright posts, each of the posts having a main body comprising a rear portion, two side portions extending from the rear portion and a support member extending between the two side portions;

wherein the method comprises:

attaching a thermally insulating front element to the main body by means of at least one connection element, which is arranged at a central area of the support member of the main body, wherein said central portion is laterally spaced apart from the two side portions, and wherein the extension of the area of contact between the insulating front element and the support member provided by the connection element in a direction parallel to the horizontal extension of the insulating front element is less than 10% of said horizontal extension of the insulating front element.

* * * * *